United States Patent [19]

McConnell

[11] Patent Number: 4,592,695

[45] Date of Patent: Jun. 3, 1986

[54] SHAMPOO LIFT FOR A WHEELCHAIR

[76] Inventor: Sylvia J. McConnell, P.O. Box 4048, Opelika, Ala. 36801

[21] Appl. No.: 662,578

[22] Filed: Oct. 19, 1984

[51] Int. Cl.[4] ..... A47C 31/00

[52] U.S. Cl. ..... 414/678; 269/323; 297/DIG. 4; 410/51; 414/680; 414/778; 414/921

[58] Field of Search ..... 414/678, 680, 754, 778, 414/921; 297/DIG. 4; 269/323; 410/51

[56] References Cited

U.S. PATENT DOCUMENTS

| | | | |
|---|---|---|---|
| 3,240,935 | 3/1966 | Dougall | 269/323 |
| 3,476,404 | 11/1969 | Rachman | 297/391 X |
| 3,806,109 | 4/1974 | Weber et al. | 269/323 |
| 3,844,421 | 10/1974 | Nielsen | 414/678 |
| 4,060,271 | 11/1977 | Williams | 410/51 X |
| 4,192,549 | 3/1980 | Petersen | 297/464 |
| 4,221,370 | 9/1980 | Redwine | 269/323 |
| 4,527,944 | 7/1985 | Qually et al. | 414/678 |

FOREIGN PATENT DOCUMENTS

| | | | |
|---|---|---|---|
| 226351 | 1/1960 | Australia | 414/754 |

*Primary Examiner*—Leslie J. Paperner

*Attorney, Agent, or Firm*—George J. Porter

[57] ABSTRACT

A tilting platform lift device for wheelchairs is disclosed. The device (10) securely holds a wheelchair (14) and tilts the wheelchair (14) backward up to 90 degrees to shampoo the hair of the person (12) in the wheelchair (14). The device comprises a tilting platform floor (18) with attached frame (70), a motordriven hydraulic system (24) which includes double-acting hydraulic cylinder (34), four-way control valve (45), electric motor (50), hydraulic pump (48) and hydraulic reservior (52). System (24) is enclosed in case (26) which also acts as a base for platform floor (18). In operation, a person (12) in wheelchair (14) rolls backward up ramp (16) and is secured to platform floor (18) by chains (22), which attach to the arms of wheelchair (14), and chains (23), which attach to the lower frame of wheelchair (14). Platform floor (18) may be tilted forward and backward by operating lever (56).

3 Claims, 4 Drawing Figures

SHAMPOO LIFT FOR A WHEELCHAIR

TECHNICAL FIELD

The present invention relates to a lift device for a wheelchair and more particularly to a hydraulic lift device which is capable of accommodating a person in a wheelchair and of securely holding the wheelchair and tilting the wheelchair backwards so that a beauty operator may shampoo the hair of the person in the wheelchair.

BACKGROUND OF THE INVENTION

Beauticians or beauty operators have a problem in administering beauty care to a patient or a client in a wheelchair. It is particularly difficult when it is necessary to shampoo the patient's hair, since this customarily requires tilting the patient's body and head backwards.

One way to administer a shampoo to a wheelchair patient is to lift the patient out of the wheelchair and into a shampoo chair. It is easy then to tilt the patient backwards for a shampoo, since the shampoo chair is made for this purpose. However, this is not a very good solution to the problem since it takes at least two people to lift the patient out of the wheelchair and into the shampoo chair. Even with two persons doing the lifting, there is still a possibility that the wheelchair patient might be dropped or otherwise injured during this process.

Another solution might be to simply tilt the wheelchair backward by hand, with the patient in it. However, this may frighten the person in the wheelchair or at least may make the person apprehensive or nervous. This also requires at least two persons to tilt the wheelchair and involves a possibility of injury to the patient and even injury to the persons who are tilting the wheelchair.

It may be seen from the above discussion that neither of the mentioned ways of administering a shampoo to a wheelchair patient is very satisfactory. Lifting the patient out of the wheelchair and into a shampoo chair is not a satisfactory approach. Neither is tilting the wheelchair backwards because of the requirement for at least two persons to perform this task and the fact that the wheelchair patient may be allowed to fall and possibly sustain injury.

Several prior art patents are considered interesting because they in one way or another relate to the above mentioned problems. U.S. Pat. No. 4,227,740 to EAST shows a simple attachment for a wheelchair which allows a wheelchair to be tilted backward so that the patient can rest or sleep. However, this structure is somewhat light and flimsy and does not instill confidence in the wheelchair patient. Moreover, this device does not have sufficient versatility to accomplish the objects of this invention since it may be tilted backward to only one angle, which is about 55 degrees from the vertical. This is not really sufficient for the purpose of giving a shampoo to a patient. For maximum convenience in giving a shampoo, the patient must really be tilted backward about 80 degrees or more.

A second prior art patent of interest is U.S. Pat. No. 4,158,524 to SERAFIN. This patent shows a platform for raising a wheelchair from ground level to a higher level, such as a porch. This patent does not contemplate and does not show any structure for securely holding the wheelchair on the platform and tilting the platform through an angle of 45 degrees to 90 degrees in order to shampoo the handicapped or injured person's hair.

U.S. Pat. No. 4,024,960 to FORSTER shows a large tilting platform for raising one end of a truck or car. However, this platform is considerably larger than would be necessary to hold a wheelchair. Moreover, this patented invention does not contemplate securing anything to the platform while it is being raised and of course does not provide any structure for securing a wheelchair to this platform.

None of the known prior art patents mentioned above contemplate raising and tilting a wheelchair on a platform and securing the wheelchair securely to the platform in order to tilt it through an angle of 45 degrees to 90 degrees for purposes of shampooing the hair of a wheelchair patient.

Therefore, it is an object of this invention to provide a tilting platform with a framework attached to the platform for securely holding a wheelchair on the platform, for shampooing the hair of a wheelchair patient without the patient having to leave his wheelchair.

It is another object of this invention to provide a wheelchair lift which can tilt a wheelchair backwards through an angle of 45 degrees to 90 degrees, for shampooing the hair of a person in the wheelchair.

It is a further object of this invention to provide a tilting platform for a wheelchair, the platform having a motor-driven hydraulic mechanism to operate the device.

It is yet another object of this invention to provide a tilting platform for a wheelchair, the platform being arranged to be simply and quickly operated by the use of a hand lever.

It is a still further object of this invention to provide a safe and efficient device, requiring only one operator, for securely holding a wheelchair and tilting the wheelchair backwards in order to shampoo the hair of a person in the wheelchair.

SUMMARY OF THE INVENTION

The present invention is a tilting platform lift device for a wheelchair. It is capable of securely holding a wheelchair on its platform and of tilting a person sitting in the wheelchair backward, through an angle of up to 90 degrees, for the purpose of shampooing the person's hair. The invention comprises: a base; a tilting platform attached to said base; means attached to said platform for tilting said platform; and means attached to said platform for securely holding a wheelchair on said platform.

DETAILED DESCRIPTION OF THE INVENTION

The present invention is a tilting platform for a wheelchair. It is capable of securely holding a wheelchair and tilting a person sitting in the wheelchair backward through an angle of up to 90 degrees, for the purpose of shampooing the person's hair.

Figure 1:
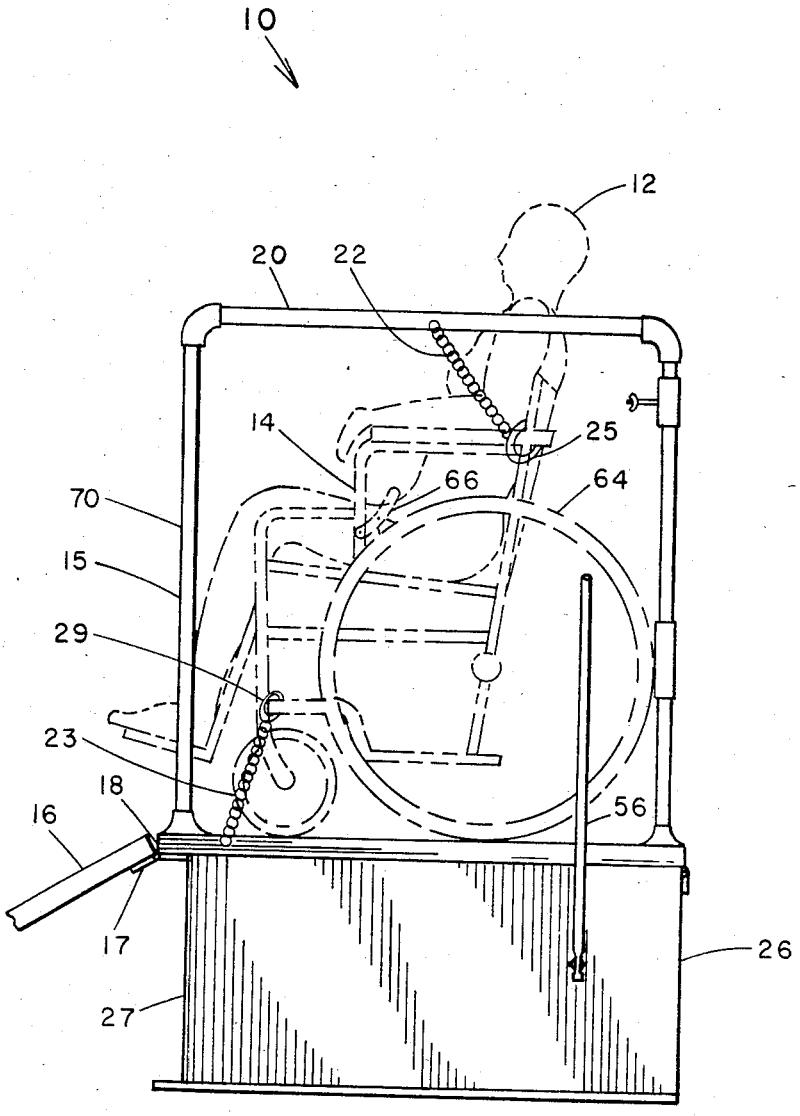
FIG. 1 is side view of the shampoo lift which comprises the invention, with a person in a wheelchair sitting on the platform of the invention.

Looking now at the side view of the invention shown in FIG. 1, the tilting shampoo lift for a wheelchair is indicated generally by the numeral 10. As shown, a person 12 sitting in wheelchair 14 has been pushed up ramp 16 backwards with the wheelchair 14 now sitting on the platform floor 18 of platform 15. Platform 15 comprises platform floor 18 and, attached to platform 18, frame 20 and ramp 16. Chair 14 is firmly secured to the two sides 70 of frame 20 by use of two chains 22, each chain 22 having a snap ring 25 which may be fastened to one arm of wheelchair 14. Each of the chains 22 is attached to one of the sides 70 of frame 20. Also, wheelchair 14 is firmly attached to platform floor 18 by two chains 23, each chain 23 having a snap ring 29 which may be fastened to the lower frame of wheelchair 14. A wheel lock 66 on each wheel 64 of wheelchair 14 is latched to prevent the wheelchair 14 from rolling on platform floor 18. Platform floor 18 rests on case 26 for the operating mechanism and also on the two front vertical supports 27. Ramp 16 is attached to the front edge of platform floor 18 by a plurality of hinges 17.

Figure 2:
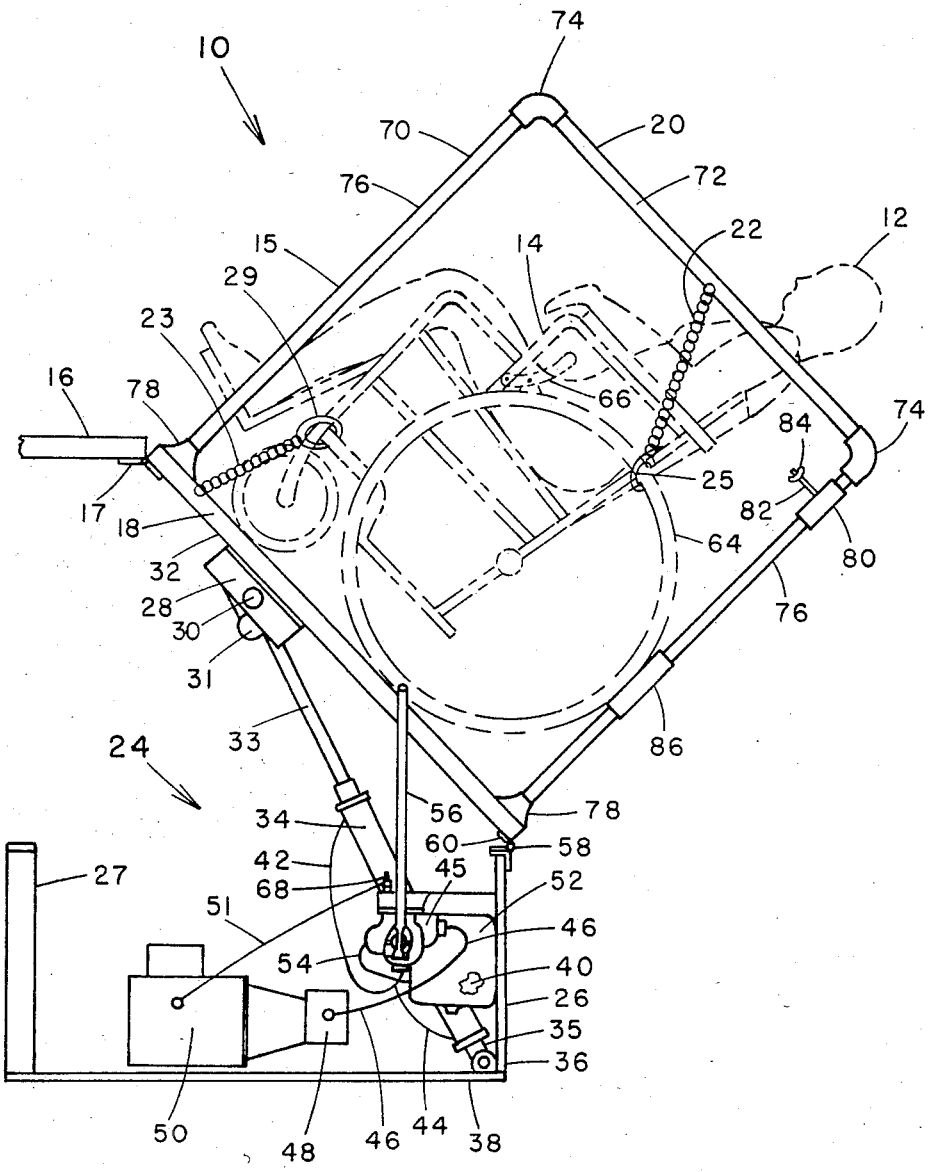
FIG. 2 is a side view of the shampoo lift as shown in FIG. 1, but with the platform tilted backward.

FIG. 2 (which is a side view as shown in FIG. 1 but with the platform and wheelchair tilted backwards) shows the details of the operating mechanism 24 of the tilting shampoo lift 10. Mechanism 24 is housed in case 26 which, together with vertical supports 27, acts as the base for platform floor 18. A bracket 28 with pivot pin 30 is attached to the underside 32 of platform floor 18. One end 31 of piston rod 33 of a double-acting hydraulic cylinder 34 is rotatably attached to pivot pin 30 of bracket 28. The opposite end 35 of hydraulic cylinder 34 is rotatably attached to the lower part of mechanism case 26, at a point where the side 36 of case 26 meets the floor panel 38 of case 26. Cylinder 34 is operated by hydraulic fluid 40 flowing through hydraulic lines 42 and 44 from four-way hydraulic control valve 45. Control valve 45 is supplied with hydraulic fluid 40 through hydraulic line 46 under pressure from hydraulic pump 48, which is driven by electric motor 50. Electric motor 50 is operated by motor control switch 68, which is connected to motor 50 by wiring 51. Control valve 45 is also connected to hydraulic reservoir 52, which supplies hydraulic fluid 40 to control valve 45 through hydraulic line 54. Operating mechanism 24 is operated by lever handle 56.

Frame 20 comprises two sides 70, back brace 80 and wheel brace 86. Each side 70 is fabricated of one horizontal section of pipe 72 connected by elbows 74 to two vertical sections of pipe 76, which are in turn each attached to platform floor 18 by use of a tapped flange 78. Sides 70 are connected together at the back by back brace 80, which is adjustable for height and removeable by use of bolts 82 and wing nuts 84. Wheel brace 86 is permanently attached to the two rear vertical pipe sections 76 about midway between back brace 80 and platform floor 18.

Figure 3:
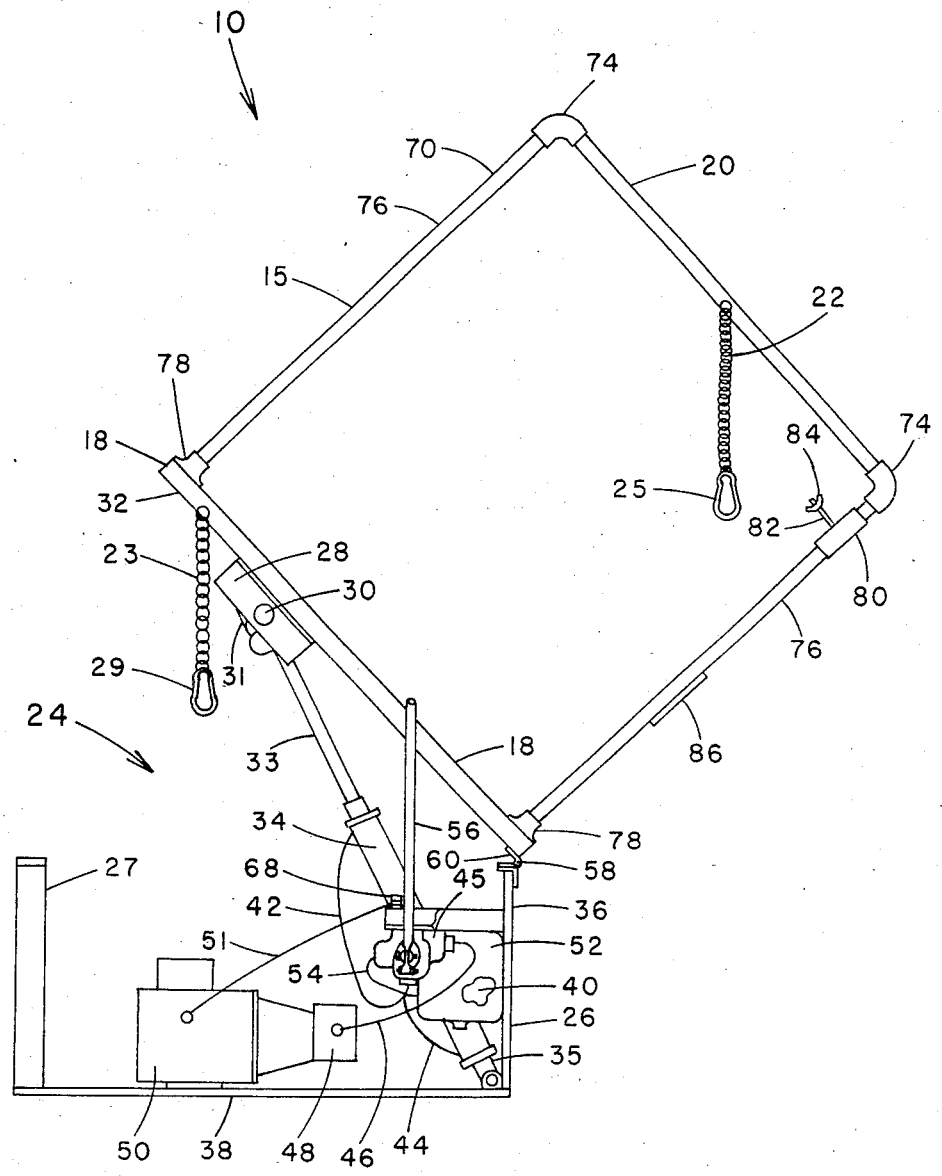
FIG. 3 is a side view of the invention as shown in FIG. 2, but with the ramp removed and without a wheelchair on the platform.

FIG. 3 is a side view of the shampoo lift 10 with the ramp 16 (FIGS. 1 and 2) removed and without a wheelchair 14 (FIGS. 1 and 2) on the platform. This figure shows the platform floor 18, with frame 20 attached, tilted up through an angle of about 45 degrees. Platform floor 18 tilts about the hinge pin 58 of piano hinge 60.

Figure 4:
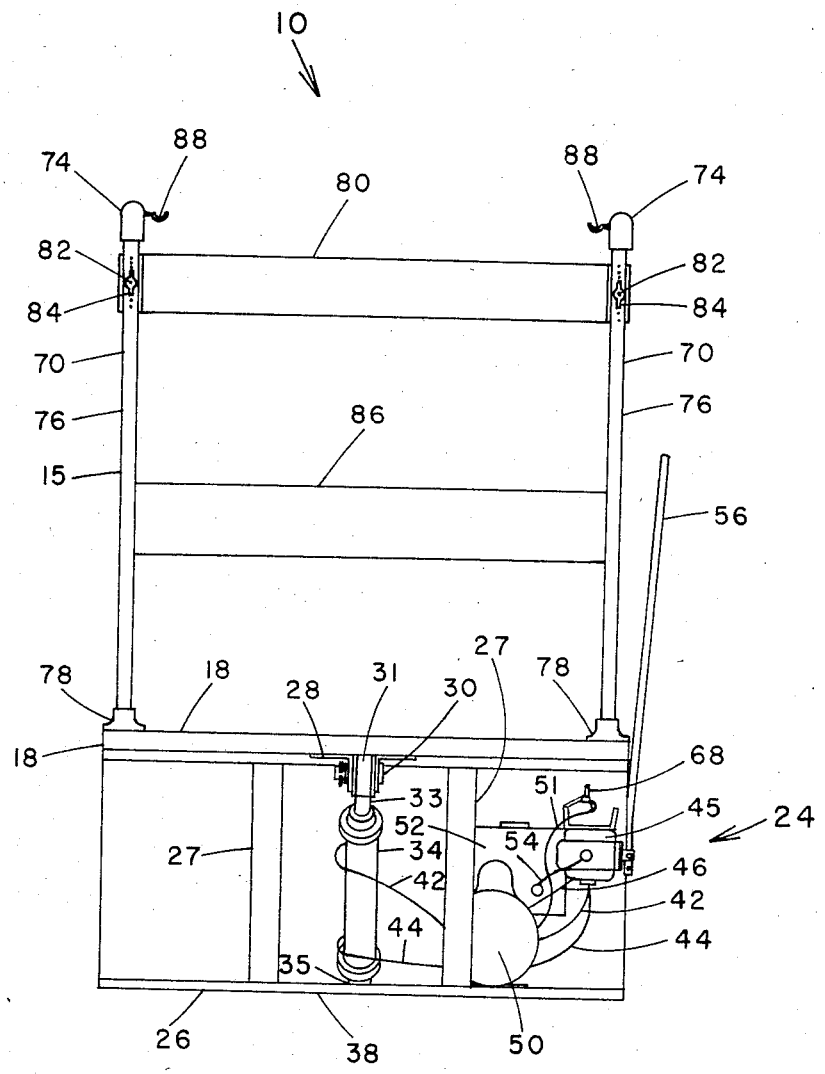
FIG. 4 is a front view of the invention as shown in FIG. 1, with the ramp and front panel of the operating mechanism case removed.

FIG. 4 is a front view of the invention 10 with both the front panel of case 26 and the ramp 16 removed to give a clear front view of operating mechanism 24. Viewed from the front, operating mechanism 24 takes on a different perspective. In FIG. 4, it may be seen that operating lever 56 is directly attached to the side of four-way hydraulic control value 45. Viewed from this direction, motor 50 is in front of control valve 45 and hydraulic reservoir 52 is behind control valve 45. Hydraulic cylinder 34 is shown in FIG. 4 almost as an end view, with its upper end 31 and piston rod 33 obviously closer to the viewer than its lower end 35, which is attached to the junction of the lower back wall of the wall of case 26 and the floor panel 38 of case 26. The hydraulic lines, including 42 and 44 connecting valve 45 with cylinder 34, hydraulic line 54 connecting valve 45 and hydraulic reservoir 52, and hydraulic line 46 connecting pump 48 (not shown in FIG. 4) and valve 45, are all seen in quite different perspective than in FIGS. 2 and 3. In this view, both frames 70, connected by back brace 80 and wheel brace 86, may be seen. Also visible in this view are both sets of bolts 82 and wing nuts 84, which are used to attach brace 80 to both side frames 70 and to adjust the height of back brace 80. As may be seen best in FIG. 4, chains 22 (not shown in FIG. 4) may be attached to hooks 88 in order to adjust the length of chains 22 as necessary to secure wheelchair 14.

To operate the shampoo lift 10, and referring now to FIGS. 1 and 2, a person 12 in a wheelchair 14 is wheeled up the ramp 16 onto the platform floor 18 and is then securely fastened in position by attachment of wheelchair 14 to both horizontal pipe sections 72 using chains 22. Chains 23, attached on one end to platform floor 18, are also hooked to the lower frame of wheelchair 14 to hold the wheelchair 14 securely on platform floor 18. The two wheels 64 of the wheelchair 14 are also securely locked by two wheel locks 66, one lock 66 being located on each wheel 64 of the wheelchair 14 itself. The motor switch 68 is turned on. The hand lever 56, is pulled backward to cause the hydraulic cylinder 34 to tilt the platform floor 18 backward. The wheelchair 14, being fastened to the platform floor 18, also tilts backward. This brings the head of the person 12 in the wheelchair 14 to a shampoo bowl (not shown) behind the person 12. After the shampoo is completed, the operator pushes the lever 56 forward, toward the platform floor 18. Double acting hydraulic cylinder 34 then pulls platform floor 18 back to the horizontal position, where it rests on case 26 and vertical supports 27. Electric switch 68 is then cut off.

From the above, it may be seen that the invention provides a tilting platform lift which can securely hold a wheelchair with a person in the wheelchair and tilt the wheelchair backwards through an angle up to 90 degrees so that the hair of the person in the wheelchair may easily be given a shampoo. The platform lift may be safely, quickly, and easily tilted backward by a single operator. The lift device is operated by a single hand lever which controls a motor-driven hydraulic operating mechanism.

I claim:

1. A tilting platform lift device capable of securely holding a wheelchair with a person in said wheelchair and tilting said wheelchair backwards for giving said person a shampoo, comprising:

a base comprising a rectangular case and two vertical supports attached to the front of said case;

a tilting plâtform attached to said base, said platform comprising a rectangular platform floor;

means attached to said platform floor for tilting said platform, said means comprising an operating system mounted in said case, said operating system comprising:

a double-acting hydraulic cylinder, one end of said cylinder being attached to said case and the opposite ends of said cylinder being attached to said platform floor;

a suitable quantity of hydraulic fluid in said system;

a four-way hydraulic control valve;

first and second hydraulic lines connecting said control valve to said double-acting cylinder, the first said line being connected to one end of said cylinder and the second said line being connected to the other end of said cylinder;

an electric motor mounted in said case;

a hydraulic pump attached to said motor, for providing pressure to said operating system;

a third hydraulic line connecting said pump and said control valve, for providing hydraulic pressure to said control valve and other portions of said operating system;

a hydraulic reservoir mounted in said case, for providing said hydraulic fluid to said system;

a fourth hydraulic line connecting said valve and said reservoir; and an operating lever attached to said four-way control valve for operating said tilting platform lift so as to cause said double-acting cylinder to tilt said platform either backwards or forwards under power;

means attached to said platform for securely holding a wheelchair on said paltform; and a piano hinge attached to the back edge of said platform floor and to the back edge of said rectangular case, for permitting said operating system to tilt said platform backwards and upwards.

2. The tilting platform lift of claim 1 wherein said platform comprises:

a frame attached to said platform floor; and a ramp attached to the front edge of said platform floor.

3. The tilting platform lift of claim 2 wherein said means for holding a wheelchair comprises a plurality of first chains attached to said frame of said platform, each said first chain comprising means attached to the end of said first chain for easy attachment to the arms of said wheelchair and a plurality of second chains attached to said platform floor, each said second chain comprising means attached to the end of said second chain for easy attachment to the lower frame of said wheelchair.

* * * * *